US005957789A

United States Patent [19]

Ainscough et al.

[11] Patent Number: 5,957,789

[45] Date of Patent: Sep. 28, 1999

[54] SOCCER TRAINING DEVICE

[76] Inventors: Brian Ainscough, 337 Bolivar St., Apt. 1B; James Govatsos, 38 Elm St., both of Canton, Mass. 02021

[21] Appl. No.: 08/995,547

[22] Filed: Dec. 22, 1997

[51] Int. Cl.[6] ..... A63B 69/00

[52] U.S. Cl. ..... 473/423

[58] Field of Search ..... 473/423, 424, 473/425, 429, 575, FOR 160, 212, 213, 214, 147

[56] References Cited

U.S. PATENT DOCUMENTS

| | | | |
|---|---|---|---|
| 3,351,343 | 11/1967 | Papp | 473/147 X |
| 3,397,885 | 8/1968 | Nash, Jr. | 473/147 X |
| 3,498,613 | 3/1970 | Dreyer | 473/575 |
| 4,561,661 | 12/1985 | Walker et al. | 473/423 |
| 5,443,576 | 8/1995 | Hauter | 473/424 |
| 5,620,186 | 4/1997 | Dudley | 473/423 |

*Primary Examiner*—William H. Grieb
*Attorney, Agent, or Firm*—Samuels, Gauthier & Stevens

[57] ABSTRACT

A soccer training device is provided which includes a soccer ball positioned within a net. A flexible substantially inelastic cord is secured, at one end, to the net and at a second end to a first swivel which permits the rope to rotate 3600 degrees about its longitudinal axis. The first swivel is mounted to a first end of an arm having a second end connected to a second swivel which permits the arm to rotate 360 degrees. The arm is secured to a fixed substrate.

9 Claims, 3 Drawing Sheets

SOCCER TRAINING DEVICE

BACKGROUND OF THE INVENTION

1. Field of the Invention

This invention relates to a soccer training device. More particularly, this invention relates to a soccer training device which includes a soccer ball secured to a flexible, substantially inelastic cord which, in turn, is secured through swivel connections to a fixed support.

2. Description of Prior Art

Practice time is essential for improving proficiency for the game of soccer. The ability for dribbling the soccer ball and for kicking the ball with force and direction are substantially improved with practice. Unfortunately, practice with an untethered soccer ball requires substantial ball retrieval time, thereby reducing effective practice time. Alternatively, the use of an untethered ball requires the presence of at least one other player which requires scheduling to permit such practice.

It has been proposed in U.S. Pat. No. 4,561,661 to provide a soccer training device wherein a soccer ball is secured to an inflexible rod such as a fiberglass rod, which, in turn is rotatably mounted on a fixed base. Since the support rod is inflexible, the ball is not allowed to rotate in the manner a ball is rotated during a soccer game. Thus, it is difficult for the player to acquire a realistic feel for the ball which approaches a player at different rates and direction of rotation as occurs during a game.

It also has been proposed in U.S. Pat. No. 5,620,186 to provide a soccer training device which includes a soccer ball which is tethered to a fixed anchor by a flexible elastic cord such as a bungee cord. The elastic cord undesirably causes the ball to move in a oscillating path toward and away from the player so that a significant portion of the time the ball is oscillating, the ball is not available to the player for contact with the player's foot. In addition, the cord is secured to the fixed anchor in a manner such that the cord becomes wound around the anchor which reduces the length the ball is positioned away from the anchor. This, in turn, requires the player to unwind the cord from the anchor thereby reducing practice time.

Accordingly, it would be desirable to provide a soccer training device which avoids the need for a player in addition to a practicing player or for substantial ball retrieval time. In addition, it would be desirable to provide such a soccer training device which permits the soccer ball to move in a manner which closely approximates ball movement under game conditions. In addition, it would be desirable to provide such a device which does not require the player to adjust the position of the ball with respect to a means for tethering a ball.

SUMMARY OF THE INVENTION

The present invention provides a soccer training device which includes a soccer ball tethered to a flexible, substantially inelastic cord which, in turn, is attached to a fixed substrate. The cord is secured to the fixed substrate by two swivel connections. A first swivel connection permits the cord to rotate 360 degrees about its central longitudinal axis. The second swivel connection permits the cord and ball to rotate 360 degrees about the fixed substrate.

The first swivel connection prevents the cord from winding upon itself and, therefore, permits the ball to be secured to a flexible connection. The second swivel prevents the rope from winding about the fixed substrate. The total effect of maintaining a flexible connection to the ball and maintaining the initial length between the ball and the fixed substrate permits continuous, uninterrupted practice. In addition, the two swivels permit the ball to rotate in an unrestricted manner governed only by the force and direction the player contacts the ball with the foot so that ball movement closely approximating game conditions is achieved.

DESCRIPTION OF SPECIFIC EMBODIMENTS

The present invention provides a soccer training device which permits a tethered ball to move translationally and rotationally in a manner which simulates realistic ball movement encountered during a soccer match. A soccer ball is tethered to one end of a flexible substantially inelastic cord. The second end of the cord is attached to a first swivel connection which permits the cord to rotate 360 degrees about a central longitudinal axis of the cord. The first swivel is mounted on a solid arm which, in turn is connected to a fixed substrate such as a post through a second swivel connection which permits the arm to rotate 360 degrees about the fixed substrate.

By the term "substantially inelastic" in describing the cord is meant that the fibers or strands forming the cord experience very little stretching or expansion other than a tensile or compression force which tightens or loosens the fit between adjacent fibers or strands. This cord is in contrast to a bungee cord which stretches substantially under a tensile force.

The soccer ball is enclosed within a containment means which permits exposure of a substantial portion of the ball's surface so that the player is able to acquire a recognition of the reactive nature of the ball when applying force with a foot to the ball. Such containment means can be a net or individual straps which extend about the ball's circumference.

Figures 1, 2:
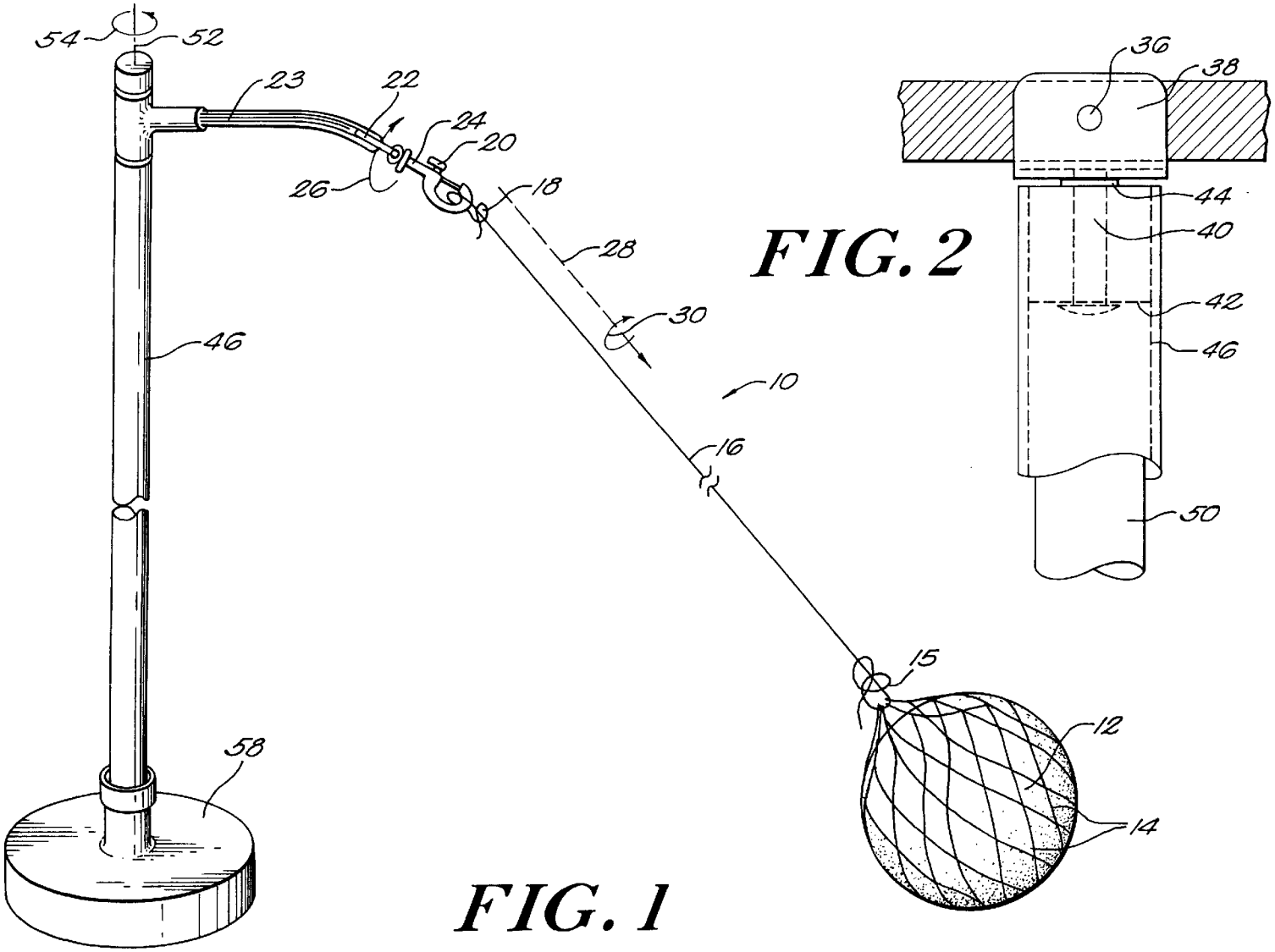
FIG. 1 is a side view of a soccer training device of this invention.
FIG. 2 is a cross-sectional view of a swivel connection between a cord and a fixed substrate of this invention.
Figure 3:
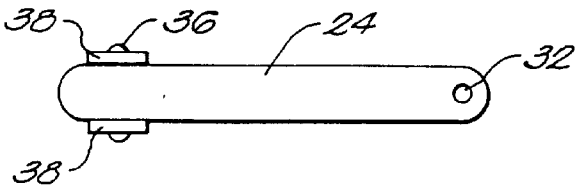
FIG. 3 is a top view of the swivel connection of FIG. 2.

Referring to FIGS. 1, 2 and 3, the soccer training device of this invention 10 includes a ball 12, a containment device 14, which comprises a net so that a substantial portion of the surface of the ball 12 is exposed. The containment device 14 is secured to one end 15 of a flexible, substantially inelastic cord 16, such a a nylon rope. A second end 18 of cord 16 is secured to a swivel connector 20 to which the cord 16 is tied. The swivel connector 20 is mounted on a ring 22 which, in turn, is mounted on arm 23 which can be formed of hard rubber, a metal or the like. The arm 24 of swivel connector 20 can rotate 360 degrees as indicated by arrow 26 so that the cord 16 can rotate 360 degrees about its longitudinal axis 28 as indicated by arrow 30. The ring 22 is mounted on through hole 32 which extends through arm 23.

The arm 23 can be rigid or flexible. It is preferred that arm 23 be flexible so that the end thereof attached to swivel connector 20 can be bent to be positioned above the training device 10 thereby preventing the cord from being wrapped about support 46. However, the arm 23 should be sufficiently rigid that it positions the swivel connector 20 and cord 16 away from the support 46, typically a distance between about 8 and 24 inches.

One end of the arm 24 is mounted on support 36 which can be a rivet or the like which extends through arm connection 38. A second rivet 40 is connected to arm 24 and is passed through washer 44 and bearing 42. Bearing 42 is fixed to the interior of support pipe 46 such as with an adhesive. A plastic rod 50 optionally can be positioned within pipe 46 to assist in supporting bearing 42. This construction permits the arm 24 to pivot 360 degrees about the central axis 52 of pipe 46 as indicated by arrow 54. The pipe 46 is positioned within the weighted pedestal 58 to form a fixed substrate.

Figure 4:
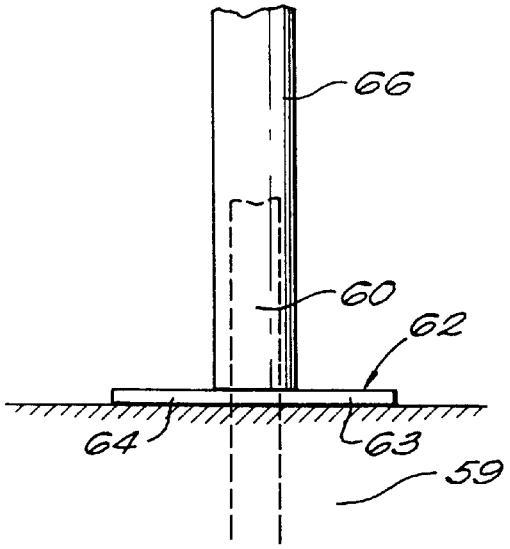
FIG. 4 is a side view of an alternative fixed substrate useful in the present invention.

As shown in FIG. 4, a support structure for the training device of this invention also can be formed from a rod 60 having a flange structure 62 which has portions 63 and 64 which extend in opposite directions. The flange structure limits the extent to which it extends into ground 59. The rod 60 extends into a pipe 66 a suitable distance, such as 12 to 36 inches. This construction permits placing the rod into the ground 59 by applying force to the flange portions 63 and 64. In addition, the flange portions prevent the rod 60 from oscillating within the ground 59 during use.

Figure 5:
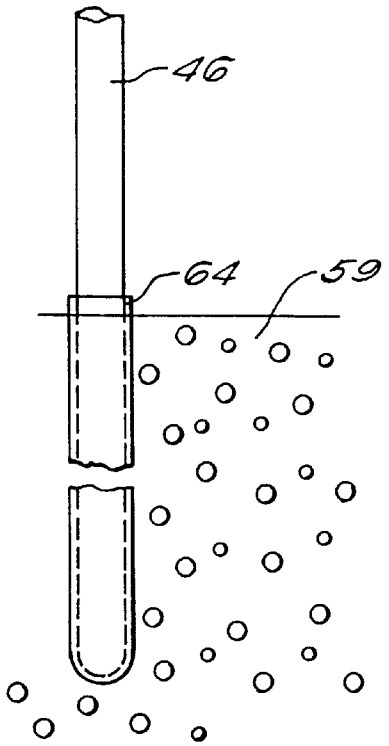
FIG. 5 is a side view of an alternative fixed substrate useful in the present invention.

As shown in FIG. 5, the pipe 46 can also be positioned within a tube 64 which is positioned within the ground 59.

Figure 6:
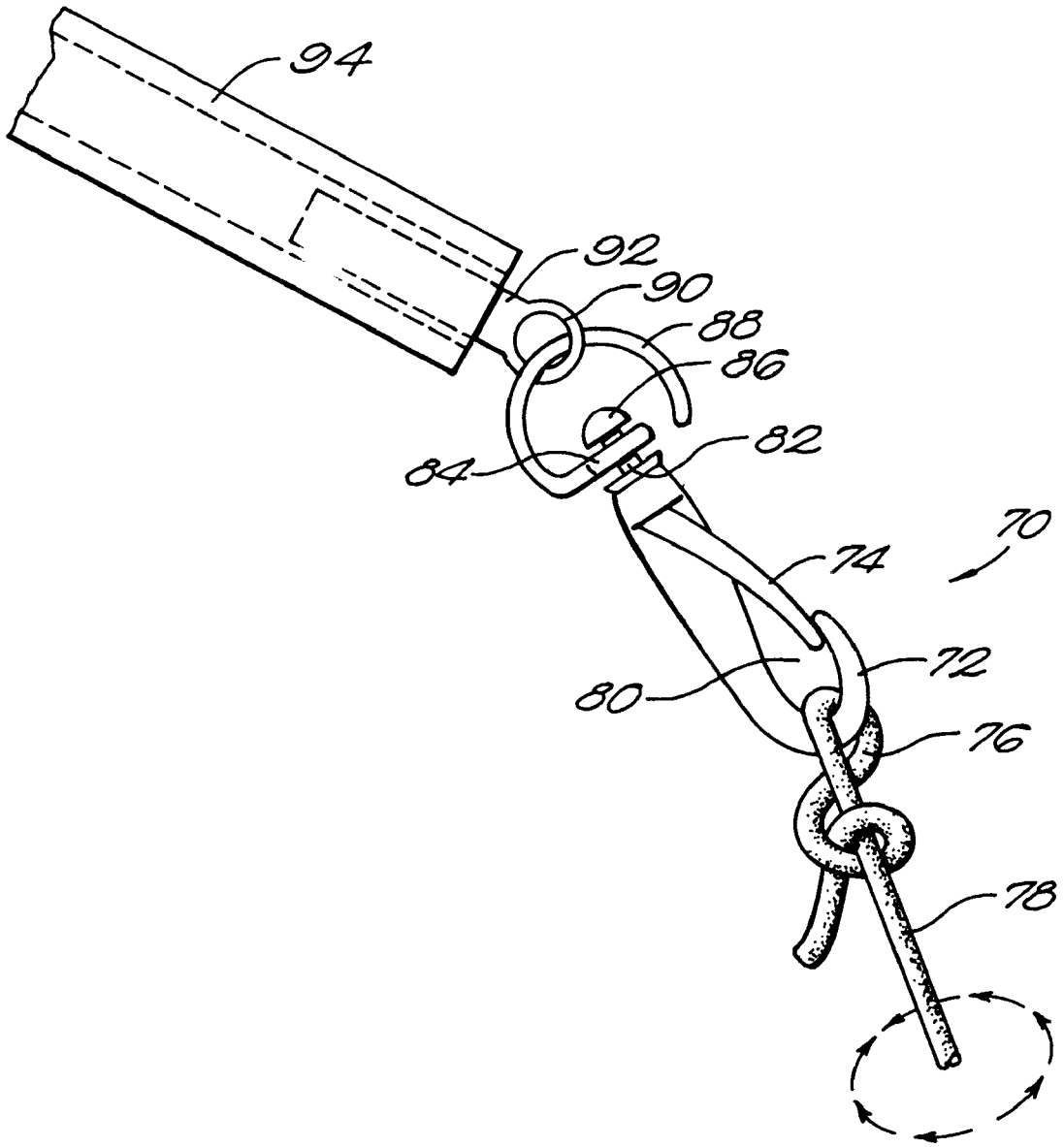
FIG. 6 is a side view of a preferred swivel connection for the present invention.

Referring to FIG. 6, the swivel construction 70 includes a hook 72 having a clasp 74 which both permits access and retains a loop 76 of cord 78 within the eye portion 80 of hook 72. A post 82 extends through a ring portion 84 and is retained therein by flange 86 attached to post 82. Ring 84 is attached to or formed integrally with loop connector 88. The loop connector 88 is secured to ring 90 of post 92 which is secured to arm 94. The cord 78 is free to rotate in the directions illustrated by arrow 96 so that the cord 78 does not wind upon itself. Since the loop connector 88 is free to move within the ring 90, it is not restrained by arm 94 and the cord 78 is free to follow the path of the moving ball.

We claim:

1. A soccer training device which comprises:

a soccer ball positioned within a containment means, a flexible, substantially inelastic cord having a first end and a second end, said first end being secured to said containment means, said second end connected to a first swivel means which permits said cord to rotate 360 degrees about a central axis of said cord, an arm having a first end and a second end, said first swivel means being connected to a first end of an arm to position said cord away from a second swivel means, a second end of said arm being connected to said second swivel means positioned at an end of a fixed substrate, which permits said arm to rotate 360 degrees and said fixed substrate being connected to said second swivel means.

2. The device of claim 1 wherein said containment means comprises a net.

3. The device of claim 2 wherein said first swivel is connected to said arm by a connecting means which permits said first swivel means to rotate relative to said arm.

4. The device of claim 2 wherein said fixed substrate is positioned into ground.

5. The device of claim 1 wherein said containment means comprises at least one strap.

6. The device of claim 3 wherein said first swivel is connected to said arm by a connecting means which permits said first swivel means to rotate relative to said arm.

7. The device of claim 1 wherein said first swivel is connected to said arm by a connecting means which permits said first swivel means to rotate relative to said arm.

8. The device of claim 7 wherein said fixed substrate is positioned into ground.

9. The device of claim 1 wherein said fixed substrate is positioned into ground.

* * * * *